US010193233B1

(12) United States Patent
Gregoire et al.

(10) Patent No.: US 10,193,233 B1
(45) Date of Patent: Jan. 29, 2019

(54) LINEARLY POLARIZED ACTIVE ARTIFICIAL MAGNETIC CONDUCTOR

(71) Applicant: HRL LABORATORIES, LLC, Malibu, CA (US)

(72) Inventors: Daniel Gregoire, Thousand Oaks, CA (US); Carson White, Agoura Hills, CA (US); Joseph Colburn, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 430 days.

(21) Appl. No.: 14/856,541

(22) Filed: Sep. 16, 2015

Related U.S. Application Data

(60) Provisional application No. 62/051,778, filed on Sep. 17, 2014.

(51) Int. Cl.
*H01Q 15/00* (2006.01)
*H01Q 15/14* (2006.01)

(52) U.S. Cl.
CPC ..... *H01Q 15/14* (2013.01); *H01Q 15/008* (2013.01)

(58) Field of Classification Search
CPC ..... H01C 15/006–15/0093
See application file for complete search history.

(56) References Cited

U.S. PATENT DOCUMENTS 4,234,960 A 11/1980 Spilsbury et al.
4,904,952 A 2/1990 Tanimoto et al.
5,392,002 A 2/1995 Delano
5,489,878 A 2/1996 Gilbert
6,081,167 A 6/2000 Kromat
6,121,940 A 9/2000 Skahill et al.
6,411,261 B1 * 6/2002 Lilly ..... H01Q 15/008 342/5
6,483,480 B1 11/2002 Sievenpiper et al.
6,509,875 B1 1/2003 Nair et al.
6,518,930 B2 2/2003 Itoh et al.
6,538,621 B1 3/2003 Sievenpiper et al.
(Continued)

FOREIGN PATENT DOCUMENTS

CN 101853974 A 10/2010
CN 102005648 A 4/2011
(Continued)

OTHER PUBLICATIONS

U.S. Appl. No. 13/910,039, Gregoire et al., filed Jun. 4, 2013.
(Continued)

*Primary Examiner* — Jessica Han
*Assistant Examiner* — Amal Patel
(74) *Attorney, Agent, or Firm* — Ladas & Parry

(57) ABSTRACT

An active artificial magnetic conductor comprising an array of unit cells, each unit cell comprising an electrically conductive patch that is connected with an electrically conductive patch of neighboring unit cell in a column of unit cells using a non-Foster negative inductor and having RF isolating plates or walls between rows of unit cells. These isolating plates or walls eliminate undesirable cross coupling between the non-Foster negative inductors. The electrically conductive patches may be formed by metallic patches preferably arranged in the 2D array of such patches. Each patch preferably has a rectilinear shape.

22 Claims, 8 Drawing Sheets

(56) References Cited

U.S. PATENT DOCUMENTS

| | | | | |
|---|---|---|---|---|
| 6,768,472 | B2 | 7/2004 | Alexopoulos et al. | |
| 6,952,565 | B1 | 10/2005 | Takeda et al. | |
| 7,042,419 | B2 | 5/2006 | Werner et al. | |
| 7,245,269 | B2 | 7/2007 | Sievenpiper et al. | |
| 7,586,384 | B2 | 9/2009 | Ranta | |
| 7,619,568 | B2 | 11/2009 | Gillette | |
| 7,847,633 | B2 | 12/2010 | Kinget | |
| 7,852,174 | B2 | 12/2010 | Cathelin et al. | |
| 7,880,568 | B2 | 2/2011 | Amin et al. | |
| 7,941,022 | B1 | 5/2011 | Schaffner et al. | |
| 8,111,111 | B2 | 2/2012 | Bezooijen | |
| 8,263,939 | B2 | 9/2012 | Delaney et al. | |
| 8,358,989 | B2 | 1/2013 | Kakuya et al. | |
| 8,374,561 | B1 | 2/2013 | Yung et al. | |
| 8,436,785 | B1 | 5/2013 | Lai et al. | |
| 8,451,189 | B1 | 5/2013 | Fluhler | |
| 8,639,203 | B2 | 1/2014 | Robert et al. | |
| 8,957,831 | B1 | 2/2015 | Gregoire et al. | |
| 8,959,831 | B2 | 2/2015 | Smith | |
| 8,976,077 | B2 | 3/2015 | Colburn et al. | |
| 8,988,173 | B2 | 3/2015 | Hitko et al. | |
| 2002/0041205 | A1 | 4/2002 | Oppelt | |
| 2004/0227668 | A1 | 11/2004 | Sievenpiper | |
| 2005/0184922 | A1 | 8/2005 | Ida et al. | |
| 2007/0182639 | A1 | 8/2007 | Sievenpiper et al. | |
| 2008/0094300 | A1 | 4/2008 | Lee | |
| 2008/0164955 | A1 | 7/2008 | Pfeiffer et al. | |
| 2008/0242237 | A1 | 10/2008 | Rofougaran et al. | |
| 2008/0284674 | A1 | 11/2008 | Herz et al. | |
| 2009/0025973 | A1 | 1/2009 | Kazantsev et al. | |
| 2010/0039111 | A1 | 2/2010 | Luekeke et al. | |
| 2010/0039343 | A1 | 2/2010 | Uno et al. | |
| 2010/0149430 | A1 | 6/2010 | Fulga et al. | |
| 2010/0225395 | A1 | 9/2010 | Patterson | |
| 2010/0231470 | A1 | 9/2010 | Lee et al. | |
| 2011/0018649 | A1 | 1/2011 | David et al. | |
| 2011/0115584 | A1* | 5/2011 | Kiji ..... | H01Q 15/142 333/81 R |
| 2012/0256811 | A1* | 10/2012 | Colburn ..... | H01Q 15/148 343/907 |
| 2013/0009720 | A1 | 1/2013 | White et al. | |
| 2013/0009722 | A1 | 1/2013 | White et al. | |
| 2013/0200947 | A1 | 8/2013 | Alexopoulos et al. | |
| 2015/0244079 | A1 | 8/2015 | White et al. | |
| 2015/0244080 | A1 | 8/2015 | Gregoire et al. | |
| 2015/0263432 | A1 | 9/2015 | White et al. | |

FOREIGN PATENT DOCUMENTS

| | | | |
|---|---|---|---|
| EP | 0295704 | A2 | 12/1988 |
| EP | 2290745 | A1 | 3/2011 |
| GB | 2288502 | A | 10/1995 |
| JP | 2008278159 | A | 11/2008 |
| TW | 200845482 | | 11/2008 |
| WO | 2006/054246 | A1 | 5/2006 |
| WO | 2009/090244 | A1 | 7/2009 |

OTHER PUBLICATIONS

U.S. Appl. No. 14/335,737, White et al., filed Jul. 18, 2014.

Adonin et al., "Monolith Optoelectronic Integrated Circuit With Built-In Photo-Voltaic Supply for Control and Monitoring," 1998 *IEEE International Conference on Electronics, Circuits and Systems*, vol. 2, pp. 529-531, (1998).

Bezooijen et al. "RF-MEMS Based Adaptive Antenna Matching Module," *IEEE Radio Frequency Integrated Circuits Symposium*, pp. 573-576, (2007).

Brennan et al., "The CMOS Negative Impedance Converter," *IEEE Journal of Solid-State Circuits*, vol. 23, No. 5, pp. 1272-1275, (Oct. 1988).

Chen, Y., "Wideband Varactorless LC VCO Using a Tunable Negative-Inductance Cell," *IEEE Transactions on Circuits and Systems, I: Regular Papers*, vol. 57, No. 10, pp. 2609-2617, (Oct. 1, 2010).

Colburn et al., "Adaptive Artificial Impedance Surface Conformal Antennas," *Proceedings IEEE Antennas and Propagation Society International Symposium*, pp. 1-4, (2009).

Costa et al., "On the Bandwidth of High-Impedance Frequency Selective Surfaces," *IEEE Antennas Wireless Propagation Letters*, vol. 8, pp. 1341-1344, (2009).

Fong et al., "Scalar and Tensor Holographic Artificial Impedance Surfaces," *IEEE Transactions on Antennas and Propagation*, vol. 58, No. 10, pp. 3212-3221, (Oct. 2010).

Foster, R. M., "A Reactance Theorem," *Bell Systems Technical Journal*, vol. 3, pp. 259-267, (1924).

Gower, J., *Optical Communications Systems*, 2nd edition, Prentice Hall, pp. 40-46, (1993).

Gregoire et al., "A Coaxial TEM Cell for Direct Measurement of UHF Artificial Magnetic Conductors," *IEEE Antennas and Propagation Magazine*, vol. 54, No. 2, pp. 251-259, (Apr. 2012).

Gregoire et al., "Non-Foster Metamaterials," *Antenna Applications Symposium 2011*, (Sep. 2011).

Gregoire et al., "Wideband Artificial Magnetic Conductors Loaded With Non-Foster Negative Inductors," *IEEE Antennas and Wireless Propagation Letters*, vol. 10, No. 26, pp. 1586-1589, (Dec. 26, 2011).

Hrabar et al., "Towards Active Dispersionless ENZ Metamaterial for Cloaking Applications," *Metamaterials*, vol. 4, No. 2-3, pp. 89-97, (Aug. 1, 2010).

Kern et al., "Active Negative Impedance Loaded EBG Structures for the Realization of Ultra-Wideband Artificial Magnetic Conductors," *IEEE Antennas and Propagation Society International Symposium*, pp. 427-430, (2003).

Kern et al., "Design of Reconfigurable Electromagnetic Bandgap Surfaces as Artificial Magnetic Conducting Ground Planes and Absorbers," *2006 IEEE Antennas and Propagation Society International Symposium*, pp. 197-200, (Jul. 9, 2006).

Linvill, J. G., "Transistor Negative-Impedance Converters," *Proceedings of the I.R.E.*, vol. 41, pp. 725-729, (Jun. 1953).

Luukkonen et al, "Simple and Accurate Analytical Model of Planar Grids and High-Impedance Surfaces Comprising Metal Strips or Patches," *IEEE Transactions on Antennas Propagation*, vol. 56, No. 6, pp. 1624-1632, (Jun. 2008).

Mechkov, C. S., "A Heuristic Approach to Teaching Negative Resistance Phenomenon," *Third International Conference—Computer Science '06*, Istanbul, Turkey, 6 pages, (Oct. 12-15, 2006).

Mirzaei et al., "A Wideband Metamaterial-Inspired Compact Antenna Using Embedded Non-Foster Matching," *2011 IEEE International Symposium on Antennas and Propagation* (*APSURSI*), pp. 1950-1953, (Jul. 3, 2011).

Pozar, David M., *Microwave Engineering*, Second Edition, John Wiley & Sons, Inc., pp. 89-90 and 629-631, (16 pages with table of contents), (1998).

Ramirez-Angulo, J. and Holmes, M., "Simple Technique Using Local CMFB to Enhance Slew Rate and Bandwidth of One-Stage CMOS op-amps," *Electronics Letters*, vol., 38, No. 23, pp. 1409-1411, (Nov. 7, 2002).

Sandel, B., Chapter 23, Radio Frequency Amplifiers, A.S.T.C., pp. 912-946, (1960).

Sievenpiper et al., "High-Impedance Electromagnetic Surfaces With a Forbidden Frequency Band," *IEEE Transactions on Microwave Theory and Techniques*, vol. 47, No. 11, pp. 2059-2074, (Nov. 1999).

Song, K.-S. and Rojas, R. G., "Non-Foster Impedance Matching of Electrically Small Antennas," *Proceedings IEEE Antennas Propagation International Symposium*, (Jul. 2010).

Staple et al., "The End of Spectrum Scarcity," published by *IEEE Spectrum*, pp. 1-5, (Mar. 2004).

Stearns, S., "Non-Foster Circuits and Stability Theory," *Proceedings IEEE Antennas and Propagation International Symposium*, pp. 1942-1945, (2011).

(56) References Cited

OTHER PUBLICATIONS

Sussman-Fort, S., "Gyrator-Based Biquad Filters and Negative Impedance Converters for Microwaves," *International Journal of RF and Microwave Computer-Aided Engineering*, vol. 8, No. 2, pp. 86-101, (1998).
Sussman-Fort, S. E. and Rudish, R. M., "Increasing Efficiency or Bandwidth of Electrically Small Transmit Antennas By Impedance Matching With Non-Foster Circuits," *Progress in Electromagnetics Research Symposium 2006*, pp. 137 and pp. 1-22, (Mar. 26-29, 2006).
Sussman-Fort, S. E., "Matching Network Design Using Non-Foster Impedances,"*International Journal of RF and Microwave Computer-Aided Engineering*, vol. 16, Issue 2, pp. 1-8, (Mar. 2006).
Sussman-Fort, S. E., Slideshow for "Matching Network Design Using Non-Foster Impedances," EDO Corporation, (43 pages), (Printed from the Internet on Jun. 30, 2011).
Sussman-Fort, S. E. and Rudish, R. M., "Non-Foster Impedance Matching for Transmit Applications," *IEEE Xplore*, EDO Corporation and Dept. of Electrical and Computer Engineering, pp. 53-56, (Mar. 6-8, 2006).
Sussman-Fort, S. E. and Rudish, R. M., "Non-Foster Impedance Matching of Electrically Small Antennas," *IEEE Transactions on Antennas and Propagation*, vol. 57, No. 8, pp. 2230-2241, (Aug. 2009).
White et al., "A Variable Negative-Inductance Integrated Circuit at UHF Frequencies," *IEEE Microwave and Wireless Components Letters*, vol. 22, No. 1, pp. 35-37, (Jan. 2012).
White Paper by the Virginia Tech Antenna Group of Wireless @ Virgina Tech, "Non-Foster Reactance Matching for Antennas," pp. 1-5, <http://wireless.vt.edu/research/Antennas_Propagation/Whitepapers/Whitepaper-Non-Foster_Reactance_Matching_for_Antennas.pdf>.
White, C. R. and Rebeiz, G. M., "A Shallow Varact-Tuned Cavity-Backed-Slot Antenna With a 1.9:1 Tuning Range," *IEEE Transactions on Antennas Propagation*, vol. 58, No. 3, pp. 633-639, (Mar. 2010).
From Chinese Patent Application No. 201280021449.5, PRC Office Action dated Sep. 29, 2015 with English translation.
From Chinese Patent Application No. 201280021746.X, PRC Office Action dated Jul. 22, 2015 with brief English summary.
From Chinese Patent Application No. 201280021746.X, PRC Office Action dated Dec. 2, 2014 with English summary.
From Chinese Patent Application No. 201280033448.2, PRC Office Action dated Oct. 27, 2014 with English translation.
From Chinese Patent Application No. 201280033448.2, PRC Office Action dated Jun. 8, 2015 with machine English translation.
From European Patent Application No. 12767559.3, EPO Supplementary European Search Report with European Search Opinion dated Jul. 29, 2014.
From European Patent Application No. 12768357.1, EPO Supplementary European Search Report with European Search Opinion dated Oct. 8, 2014.
From European Patent Application No. 12806913.5, EPO Search Report with Search Opinion dated Mar. 19, 2015.
From PCT Application No. PCT/US2012/032638, International Search Report and Written Opinion (ISR & WO) dated Oct. 29, 2012.
From PCT Application No. PCT/US2012/032638, Chapter II, International Preliminary Report on Patentability (IPRP) dated Jun. 27, 2013.
From PCT Application No. PCT/US2012/032648, International Search Report and Written Opinion (ISR & WO) dated Dec. 14, 2012.
From PCT Application No. PCT/US2012/032648, Chapter I, International Preliminary Report on Patentability (IPRP) dated Oct. 8, 2013.
From PCT Application No. PCT/US2012/045632, International Search Report and Written Opinion (ISR & WO) dated Jan. 10, 2013.
From PCT Application No. PCT/US2012/045632, Chapter II, International Preliminary Report on Patentability (IPRP) dated Jul. 10, 2013.
From PCT Application No. PCT/US2014/072233, International Search Report and Written Opinion (ISR &WO) dated Mar. 16, 2015.
From U.S. Appl. No. 12/768,563 (Now U.S. Pat. No. 8,374,561), Non-Final Rejection dated Jun. 13, 2012.
From U.S. Appl. No. 12/768,563 (Now U.S. Pat. No. 8,374,561), Notice of Allowance dated Oct. 9, 2012.
From U.S. Appl. No. 12/768,563 (Now U.S. Pat. No. 8,374,561), Notice of Allowance dated Oct. 23, 2012.
From U.S. Appl. No. 13/177,479 (Now Published as US 2013/0009720), Non-Final Rejection dated Jun. 4, 2014.
From U.S. Appl. No. 13/177,479 (Now Published as US 2013/0009720), Non-Final Rejection dated Dec. 2, 2014.
From U.S. Appl. No. 13/441,659 (Now U.S. Pat. No. 8,976,077), Non-Final Rejection dated Feb. 24, 2014.
From U.S. Appl. No. 13/441,659 (Now U.S. Pat. No. 8,976,077), Final Rejection dated Jul. 1, 2014.
From U.S. Appl. No. 13/441,659 (Now U.S. Pat. No. 8,976,077), Notice of Allowance dated Oct. 30, 2014.
From U.S. Appl. No. 13/441,730 (Now U.S. Pat. No. 8,988,173), Non-Final Rejection dated Mar. 13, 2014.
From U.S. Appl. No. 13/441,730 (Now U.S. Pat. No. 8,988,173), Notice of Allowance dated Jul. 28, 2014.
From U.S. Appl. No. 13/441,730 (Now U.S. Pat. No. 8,988,173), Notice of Allowance dated Nov. 10, 2014.
From U.S. Appl. No. 13/472,396 (Now U. S. Publication No. 2013/0009722 A1), Non-Final Office Action dated Jul. 30, 2014.
From U.S. Appl. No. 13/472,396 (Now U. S. Publication No. 2013/0009722 A1), Non-Final Office Action dated Dec. 2, 2014.
From U.S. Appl. No. 13/472,396 (Now U. S. Publication No. 2013/0009722 A1), Final Office Action dated Apr. 9, 2015.
From U.S. Appl. No. 13/472,396 (Now U. S. Publication No. 2013/0009722 Al), Non-Final Office Action dated Sep. 11, 2015.
From U.S. Appl. No. 13/910,039 (Unpublished, Non Publication Requested), Non-Final Rejection dated Jun. 15, 2015.
From U.S. Appl. No. 14/188,225 (filed Feb. 24, 2014; Now U.S. Publication No. 2015/0244080), Application and Office Actions.
From U.S. Appl. No. 14/188,264 (filed Feb. 24, 2014; Now U.S. Publication No. 2015/0244079), Application and Office Actions.
From U.S. Appl. No. 14/335,737 (filed Jul. 18, 2014; Unpublished, Non Publication Requested), Application and Office Actions.
From U.S. Appl. No. 14/628,076 (filed Feb. 20, 2015; Now U.S. Publication No. 2015/0263432 A1), Application and Office Actions.

* cited by examiner

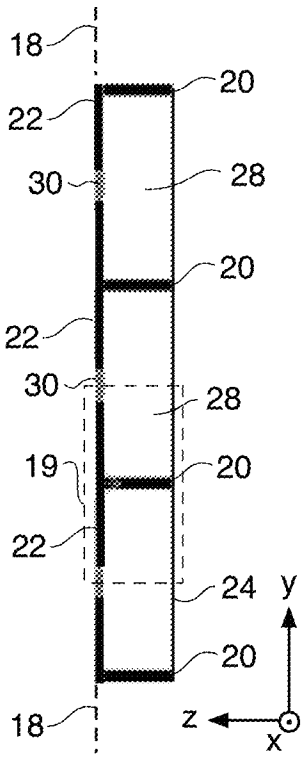
Fig. 4a2
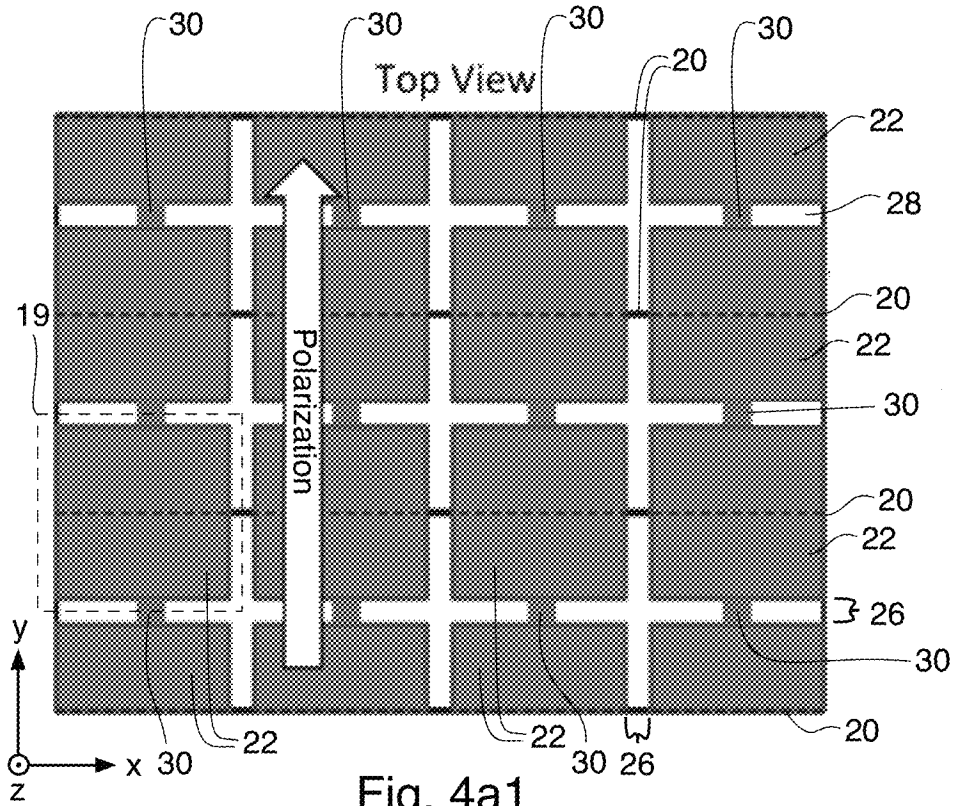
Fig. 4a1

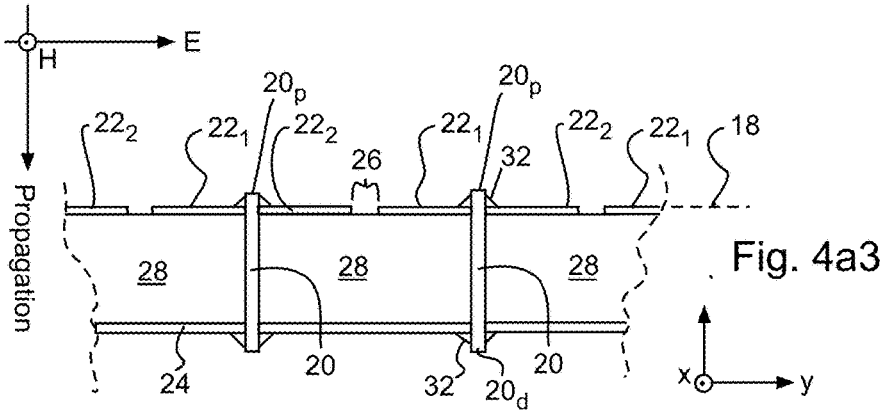
Fig. 4a3
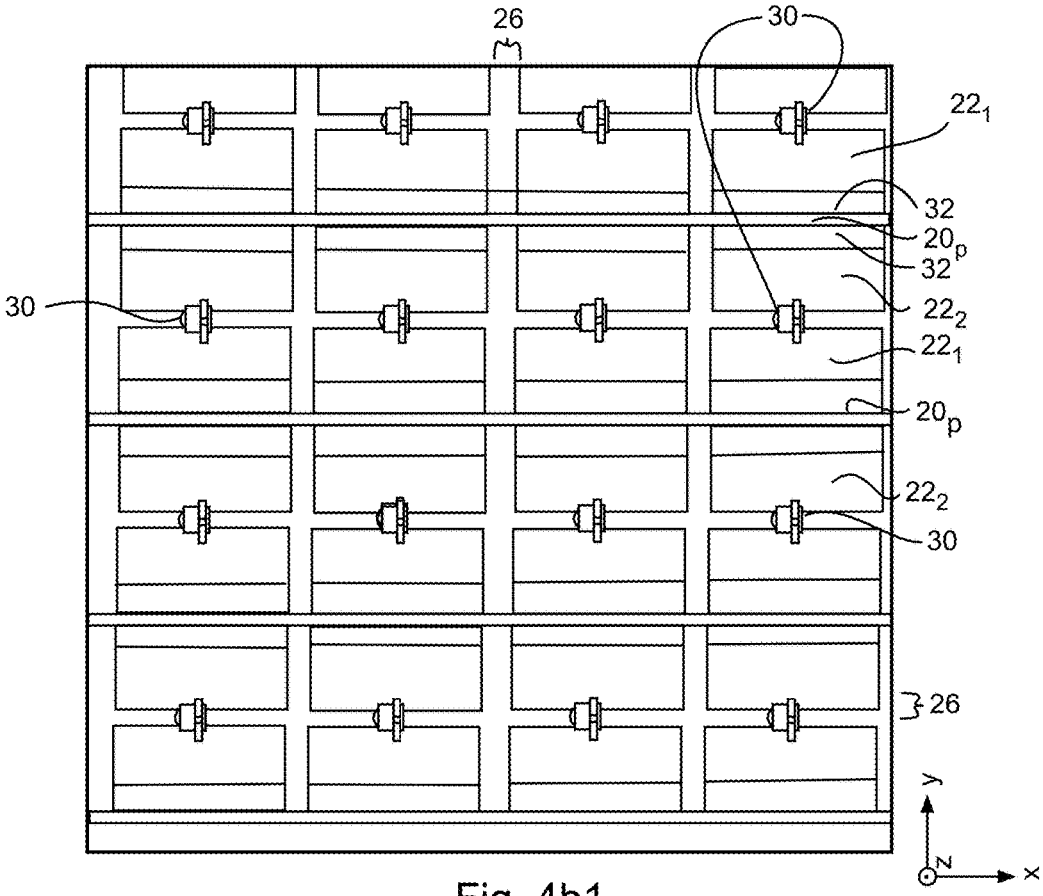
Fig. 4b1

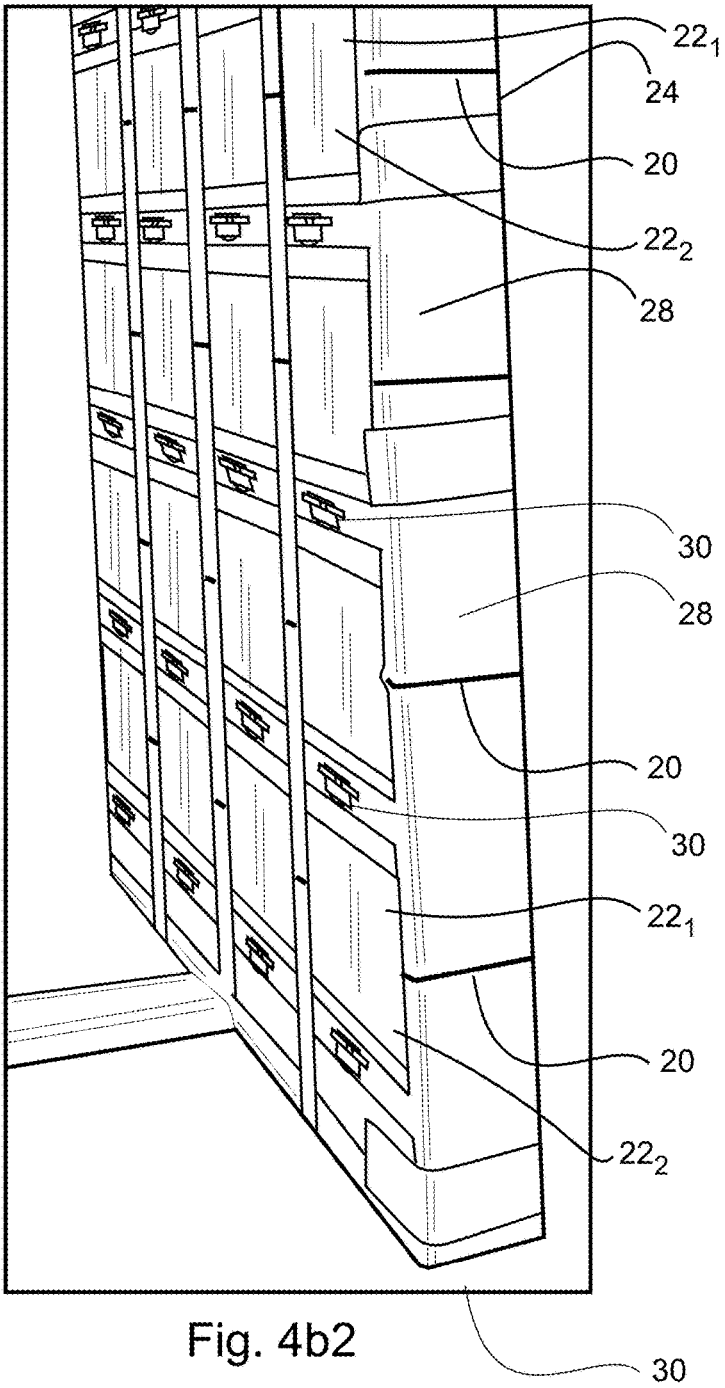
Fig. 4b2

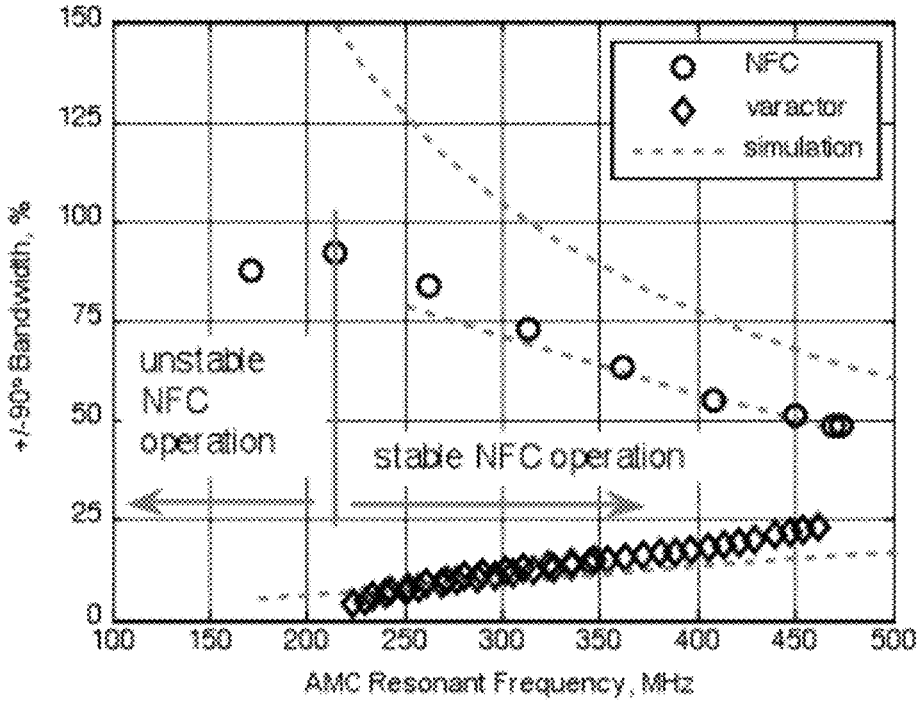
Fig. 5b
Fig. 6
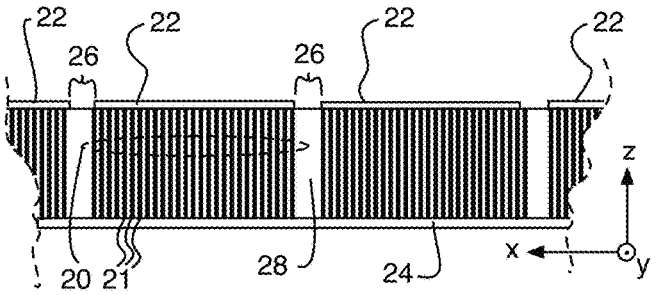

LINEARLY POLARIZED ACTIVE ARTIFICIAL MAGNETIC CONDUCTOR

CROSS REFERENCE TO RELATED APPLICATIONS

This application claims the benefit of U.S. Provisional Patent Application Ser. No. 62/051,778, filed Sep. 17, 2014 and entitled "Linearly polarized active artificial magnetic conductor", the disclosure of which is hereby incorporated herein by reference.

This application is related to (i) U.S. Pat. No. 8,976,077 issued Mar. 10, 2015 and entitled "Wideband Tunable Impedance Surfaces" and also to (ii) U.S. Pat. No. 8,988,173 issued Mar. 24, 2015 and entitled "Differential Negative Impedance Converters and Inverters with Tunable Conversion Ratios", the disclosures of which are also incorporated herein by reference.

TECHNICAL FIELD

This invention relates an active artificial magnetic conductor (AAMC) which includes a periodic array of unit cells which reflects electromagnetic waves incident on its surface with zero-degree phase shift.

BACKGROUND

It is often desirable to place antennas near and parallel to metallic surfaces. However these surfaces reflect electromagnetic waves out of phase with the incident wave, thus short circuiting the antennas. While naturally occurring materials reflect electromagnetic waves out of phase, artificial magnetic conductors (AMCs) are metasurfaces that reflect incident electromagnetic waves in phase. An Artificial Magnetic Conductor (AMC) is a type of metamaterial that emulates a magnetic conductor over a limited bandwidth. See, in this regard, Gregoire, D.; White, C.; Colburn, J.; "Wideband artificial magnetic conductors loaded with non-Foster negative inductors," *Antennas and Wireless Propagation Letters, IEEE*, vol. 10, 1586-1589, 2011 (hereinafter Gregoire) and D. Sievenpiper, L. Zhang, R. Broas, N. Alexopolous, and E. Yablonovitch, "High-impedance electromagnetic surfaces with a forbidden frequency band," *IEEE Trans. Microw. Theory Tech.*, vol. 47, pp. 2059-2074, November 1999 (hereinafter Sievenpiper).

An AMC ground plane enables conformal antennas with currents flowing parallel to the surface because parallel image currents in the AMC ground plane enhance their sources. In the prior art, AMCs have been realized with a laminated structure composed of a periodic grid of metallic patches distributed on a grounded dielectric layer. See, in this regard, the prior art documents mentioned above as well as: F. Costa, S. Genovesi, and A. Monorchio, "On the bandwidth of high-impedance frequency selective surfaces", *IEEE AWPL*, vol. 8, pp. 1341-1344, 2009 (hereinafter Costa).

AMCs are typically composed of unit cells that are less than a half-wavelength in size and achieve their properties by resonance. But such AMCs have limited bandwidth. Their bandwidth is proportional to the substrate thickness and its permeability. See, in this regard, the prior art documents mentioned above as well as: D. J. Kern, D. H. Werner and M. H. Wilhelm, "Active negative impedance loaded EBG structures for the realization of ultra-wideband Artificial Magnetic Conductors," *Proc. IEEE Ant. Prop. Int. Symp.*, vol. 2, 2003, pp. 427-430 (hereinafter Kern). At VHF-UHF frequencies, the thickness and/or permeability necessary for reasonable AMC bandwidth is excessively large for antenna ground-plane applications.

A passive AMC typically comprises metallic patches disposed above a ground plane with via holes connecting the patches to the RF ground with a dielectric medium between the patches and the RF ground. Passive AMCs must be very thick to have the operational bandwidths comparable to those achievable with much thinner active AMCs (AAMCs).

AAMC technology is applicable to a number of antenna applications including:

(1) increasing antenna bandwidth (see in this regard: White, C. R.; May, J. W.; Colburn, J. S.; "A variable negative-inductance integrated circuit at UHF frequencies," *Microwave and Wireless Components Letters, IEEE*, vol. 21, no. 12, pp. 35-37, 2011 (hereinafter White) and S. E. Sussman-Fort and R. M. Rudish, "Non-Foster impedance matching of electrically-small antennas," *IEEE Trans. Antennas Propagat.*, vol. 57, no. 8, August 2009 (hereinafter Sussman-Fort).

(2) reducing finite ground plane edge effects for antennas mounted on structures to improve their radiation pattern, (3) reducing coupling between closely spaced ($<1\lambda$) antenna elements on structures to mitigate co-site interference, (4) enabling the radiation of energy polarized parallel to and directed along structural metal surfaces, and (5) increasing the bandwidth and efficiency of cavity-backed slot antennas while reducing cavity size.

This AAMC technology is particularly applicable for frequencies <1 GHz where the physical size of the traditional AMC become prohibitive for most practical applications.

Active circuits (e.g. negative inductors or NFCs) may be employed to increase the bandwidth of a AMC, thus constituting the AAMC. The AAMC is loaded with non-Foster circuit (NFC) negative inductors to increase it bandwidth by 10 times or more. When the AMC is loaded with the NFC, its negative inductance in parallel with the substrate inductance results in a much larger net inductance and hence, a much larger AMC bandwidth. An AAMC architecture is shown in FIG. 1. However, the mere inclusion of NFCs means that the AAMC is conditionally stable and the NFCs must be designed properly to avoid undesirable oscillation. In U.S. Pat. No. 8,976,077 issued Mar. 10, 2015 and entitled "Wideband Tunable Impedance Surfaces", a method of making an AAMC is described using Non-Foster Circuits (NFCs), but it does not disclose how to ensure stability of the AAMC itself which is due to the fact that it was discovered later that NFCs (which were designed with stability in mind) used in the AAMC resulted in instability due to cross coupling in the E-plane. This instability is manifested as an uncontrolled oscillation of the NFCs and spurious emitted radiation. This instability problem is addressed by the present invention.

BRIEF DESCRIPTION OF THE INVENTION

In one aspect the present invention provides an active artificial magnetic conductor comprising an array of unit cells, each unit cell comprising an impedance element that is connected to neighboring impedance elements with non-Foster negative inductors parallel to the E plane, and having RF isolating plates between rows of unit cells parallel to the H plane. These isolating plates eliminate the undesirable cross coupling between the non-Foster negative inductors. The impedance elements may be formed by metallic patches preferably arranged in the 2D array of such patches. The metallic patches may be called impedance elements dues to the fact that present an impedance to an incoming wave. They impedance is represented by the grid admittance Yg in Eqn. 3 below.

In another aspect the present invention provides a method of electrically stabilizing an active artificial magnetic conductor comprising an array of unit cells, each unit cell comprising an impedance element that is connected to neighboring impedance elements with non-Foster negative inductors parallel to the E plane of incident RF energy, the method comprising reducing E-plane coupling between the negative inductors of the active artificial magnetic conductor by inserting RF isolating plates between rows of unit cells parallel to the H plane of the incident RF energy, each RF isolating plate extending between a ground plane of the active artificial magnetic conductor and the impedance element of each unit cell in a row thereof.

BRIEF DESCRIPTION OF THE DRAWINGS

FIG. 2*a* shows a NFC IC disposed on a carrier board while

FIGS. 4*a*1, 4*a*2, and 4*a*3 depict embodiments of a linearly-polarized AAMC with respective plan (FIG. 4*a*1) and side views (FIG. 4*a*2) of a first embodiment thereof. FIG. 4*a*3 is a side elevational view showing optional RF isolation plate connection features compared to the embodiment of FIGS. 4*a*1 and 4*a*2. RF isolation plates are installed between rows of elements to prevent coupling between NFCs in neighboring rows (i.e. along the E plane) from causing instability.

FIGS. 4*b*1 and 4*b*2 show a plan (or top) view and a side elevational perspective (or end perspective) view, respectively, of a prototype AAMC with isolating plates therein. Since this is a prototype, dielectric tape can be seen, particularly in FIG. 4*b*2, helping to hold the prototype together for testing purposes.

FIGS. 5*a* and 5*b* depict the reflection properties of the AAMC prototype of FIGS. 4*a* and 4*b*, with FIG. 5*a* showing the phase and magnitude of an incident wave when reflected from the AAMC vs. frequency for various NFC tuning and FIG. 5*b* showing the ±90° bandwidth for the AAMC and for a varactor-loaded passive AMC. The three simulations (depicted by dashed lines) are, in order of increasing bandwidth, 1) the capacitively loaded AMC, 2) the AAMC loaded with the NFC equivalent-circuit parameters, and 3) the AAMC loaded with ideal negative inductance with no parasitic circuit elements.

FIG. 6 depicts an embodiment where the isolation plates are formed by a series of posts.

DETAILED DESCRIPTION

Figure 1:
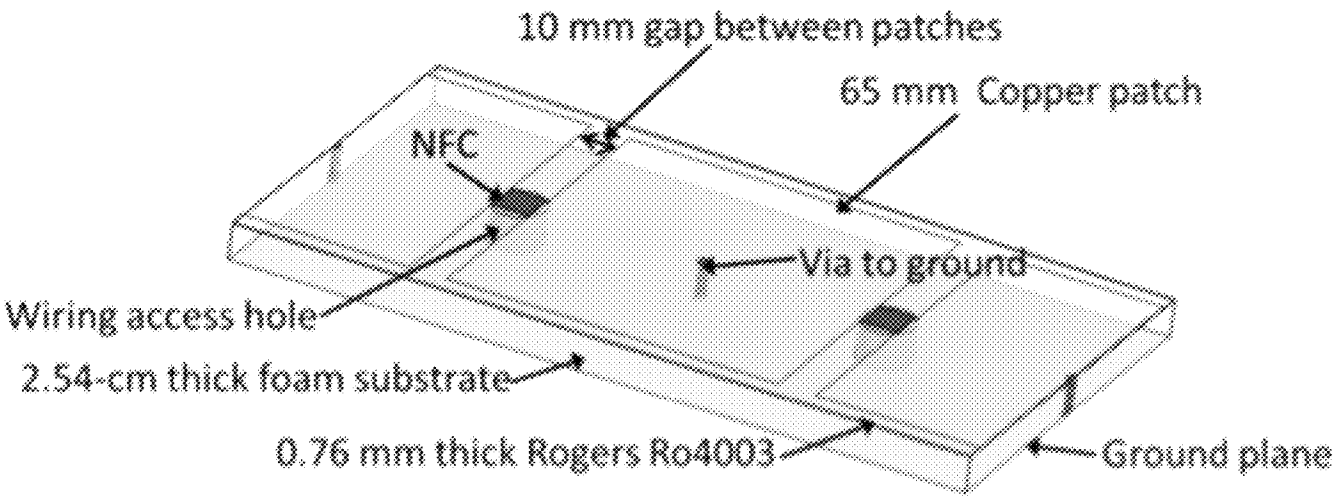
Fig. 1 prior art
FIG. 1. depicts an AAMC unit cell architecture.

This invention comprises an AAMC having a plurality of unit cells 19, each unit cell 19 comprising a metallic patch 22 disposed spaced from a ground plane 24 by a substrate 28. See FIGS. 4*a*1 and 4*a*2. The metallic patch 22 of the cells 19 are connected to a metallic patch 22 of a neighboring cell 19 with non-Foster negative inductors 30 in one direction. The AAMC further has RF isolation plates 20 disposed or arranged within the substrate 28. These isolation plates 20 stabilize the AAMC by reducing the E-plane coupling between the negative inductors.

But before discussing the use of such isolation plates 20 to stabilize the AAMC it might be useful to first discuss the theoretical underpinnings of AMCs and AAMCs in general and how NFCs 30 may be implemented.

AMCs and AAMCs

An AMC is characterized by its resonant frequency, $\omega_0$, which is where an incident wave is reflected with 0° phase shift, and by its ±90° bandwidth, which is defined as the frequency range where the reflected phase is within the range $|\varphi_r|<90°$. AMC response can be accurately modeled over a limited frequency range using an equivalent parallel LRC circuit with $L_{AMC}$, $C_{AMC}$, and $R_{AMC}$ as the circuits' inductance, capacitance and resistance respectively. See the papers by Gregoire, Costa, Kern, White identified above as well as U.S. Pat. No. 8,976,077 issued Mar. 10, 2015 noted above. The circuit impedance is $$Z_{AMC} = \frac{j\omega L_{AMC}}{1 - \omega^2 L_{AMC} C_{AMC} + j\omega L_{AMC} / R_{AMC}}. \quad \text{(Eqn. 1)}$$

The resonant frequency and approximate fractional bandwidth (see the paper by Sievenpiper identified above) in the limit $\omega_0 L_{AMC} << Z_0$ are $$\omega_0 = \frac{1}{\sqrt{L_{AMC} C_{AMC}}}, \; BW = \omega_0 L_{AMC} / Z_0, \quad \text{(Eqn. 2)}$$

where $Z_0$ is the incident wave impedance.

An AMC of the form shown in FIG. 1, where a grounded dielectric substrate is covered with a grid of electrically conductive patches loaded with lumped elements between the patches can be approximated by a simple transmission line model (see the papers by Gregoire and Sievenpiper identified above), which expresses the AMC admittance as the sum of the grid admittance $Y_g$, the load admittance $Y_{load}$, and the substrate admittance $Y_{sub}$ $$Y_{AMC} = Y_g + Y_{load} + Y_{sub}. \quad \text{(Eqn. 3)}$$

$$Y_{sub} = -j\cot\left(\sqrt{\varepsilon\mu}\,\omega d\right)\sqrt{\varepsilon/\mu}, \quad \text{(Eqn. 4)}$$

where d is the dielectric thickness, and ε and μ are the substrate's permittivity and permeability respectively. $Y_{sub}$ is expressed in terms of a frequency-dependent inductance, $L_{sub}=-j/(\omega Y_{sub})$ which is approximately a constant $L_{sub}\cong\mu d$ for thin substrates with $\sqrt{\varepsilon\mu}\omega d<<1$. The grid impedance of the impedance elements formed by the electrically conductive patches (which may be embodied, without implying a limitation, as metallic square shaped elements) is capacitive, $Y_g=j\omega C_g$, and can be accurately estimated analytically. See, in this regard, the paper by Sievenpiper identified above as well as O. Luukkonen et al, "Simple and accurate analytical model of planar grids and high-impedance surfaces", *IEEE Trans. Antennas Prop.*, vol. 56, 1624, 2008. The electrically conductive patches may assume other geometric shapes than a square shape (FIG. 1 shows a rectangular shape) and may be made of electrically conductive materials such as, without implying a limitation, metals such as copper or aluminum. Moreover a convenient metal to use is copper since the copper patches can be conveniently made from a circuit board materials. A suitable circuit board material is Rogers Corporation under their material name RO4003. Of course, other circuit board materials made by Rogers Corporation or by other manufacturers are doubtlessly suitable as well to form the electrically conductive patches on a dielectric surface with a ground plate (formed of a metal such as copper) on the opposite side of the dielectric surface from the electrically conductive patches also formed of a metal such as copper.

The loaded AMC reflection properties can be estimated by equating the LRC circuit parameters of Eqn. 1 to quantities in the transmission line model (see Eqns. 3 and 4). If the load is capacitive, then the equivalent LRC circuit parameters are $$L_{AMC}=L_{sub},\ C_{AMC}=C_g+C_{load} \text{ and } R_{AMC}=R_{load}. \quad \text{(Eqn. 5)}$$

If the load is inductive as it is in the AAMC, then they are $$L_{AMC}=\frac{L_{Load}L_{sub}}{L_{Load}+L_{sub}},\ C_{AMC}=C_g \text{ and } R_{AMC}=R_{load}. \quad \text{(Eqn. 6)}$$

An active AMC is created when the load inductance is negative, and $L_{AMC}$ increases according to (Eqn. 6). When $L_{load}<0$ and $|L_{load}|>L_{sub}>0$, then $L_{AMC}>L_{sub}$, resulting in an increase in the AMC bandwidth, and a decrease in the resonant frequency according to (Eqn. 2). When $L_{load}$ approaches $-L_{sub}$, then $L_{AMC}$ is maximized, the resonant frequency is minimized and the bandwidth is maximized. The bandwidth and resonant frequency are prevented from going to infinity and 0 respectively by loss and capacitance in the NFC and the AMC structure.

AAMCs and Non-Foster Circuits

The AAMC is loaded with non-Foster circuit (NFC) negative inductors (see the papers by Gregiore and White identified above). The NFC is the semiconductor element that enables realization of the AAMC with a relatively high bandwidth when compared with an AMC without NFCs. The words "non-Foster" in non-Foster circuit (NFC) allude to the fact that the NFC circumvents Foster's reactance theorem (see R. M. Foster., "A reactance theorem", *Bell Systems Technical Journal*, vol. 3, pp. 259-267, 1924 (hereinafter Foster)) utilizing an active circuit (preferably formed by a small semiconductor circuit) to cause the NFC to synthesize either a capacitor having a negative value or an inductor having a negative value depending upon the type of NFC utilized. The NFCs used with the AAMC herein preferably synthesize an inductor having a negative value. Details of an NFC circuit design and fabrication are given in the paper by White noted above, the disclosure of which is hereby incorporated herein by reference. A NFC synthesizing an inductor having a negative value can be represented by the equivalent circuit model shown in FIG. 2*b*. In this model, $L_{NFC}$ is the desired negative inductance, while $R_{NFC}$ is a negative resistance. $C_{NFC}$ and $G_{NFC}$ are positive capacitance and conductance, respectively. In an ideal NFC, $R_{NFC}$, $C_{NFC}$ and $G_{NFC}$ are all equal to zero. The equivalent circuit parameters vary according to the bias voltage applied and some prior-art NFC circuit parameters are plotted in the graphs of FIG. 3.

Non-Foster Circuits and AAMC Instability

The NFCs noted above can become unstable when the bias voltage goes too high and when they have detrimental coupling with neighboring NFCs. Instability is manifested as circuit oscillation and emission of unwanted radiation. Coupling between neighboring NFCs in the E plane (i.e. between NFCs in neighboring rows in FIG. 4*a*1) cause the AAMC to be unstable (but for the presence of the RF isolation plates 20 described in grater detail below). When the NFCs in an AAMC become unstable, the AAMC no longer operates as desired.

The present invention addresses the second instability problem noted in the preceding paragraph (the instability caused due to detrimental coupling with neighboring NFCs 30) by introducing RF isolation plates 20 disposed parallel to the H plane of incident RF waves on the AAMC. These isolation plates 20 preferably span the substrate 28 of the AAMC between the rows of the metallic elements or patches 22 and a ground plane 24 of the AAMC. Each isolation plate 20, when viewed in a top down view such as that seen in FIG. 4*a*1, extends linearly in a row between adjacent columns of the metallic elements or patches 22.

See FIGS. 4*a*1 and 4*a*2 which are drawings depicting a plan (or top) view and a side elevational (or end) view of a prototype AAMC, respectively. The H plane lies parallel to the x-z plane while the E plane lies parallel to the y-z plane as identified on FIGS. 4*a*1 and 4*a*2. The intended or expected polarization of the electric field denoted by the arrow on FIG. 4*a*1 marked as "polarization", which is a projection of the electric field vector of incident RF wave on the major surface of the AAMC, is in the E plane. In FIG. 4*a*1 the direction of polarization (as projected on the major surface of the AAMC) is depicted as being in the y direction; however, direction of polarization may be in a direction different than the y-direction so that is also has a x-direction component. The isolation plates 20 connect patches 22 in a row perpendicular (orthogonal) to the direction of polarization as denoted by the aforementioned arrow. In FIG. 4*a*2 the isolation plates 20 are shown abutting patches 22, but as will be seen, it may be easier to manufacture the AAMC (i) if the isolation plates 20 penetrate rather than abut patches 22 (see FIG. 4*a*3) or (ii) if the isolation plates 20 are formed by a plurality of posts 21 (see FIG. 6). The isolation plates 20 are preferably disposed along a mid point of each patch 22 in a row (in the x-direction) of patches 22.

Figure 2A:
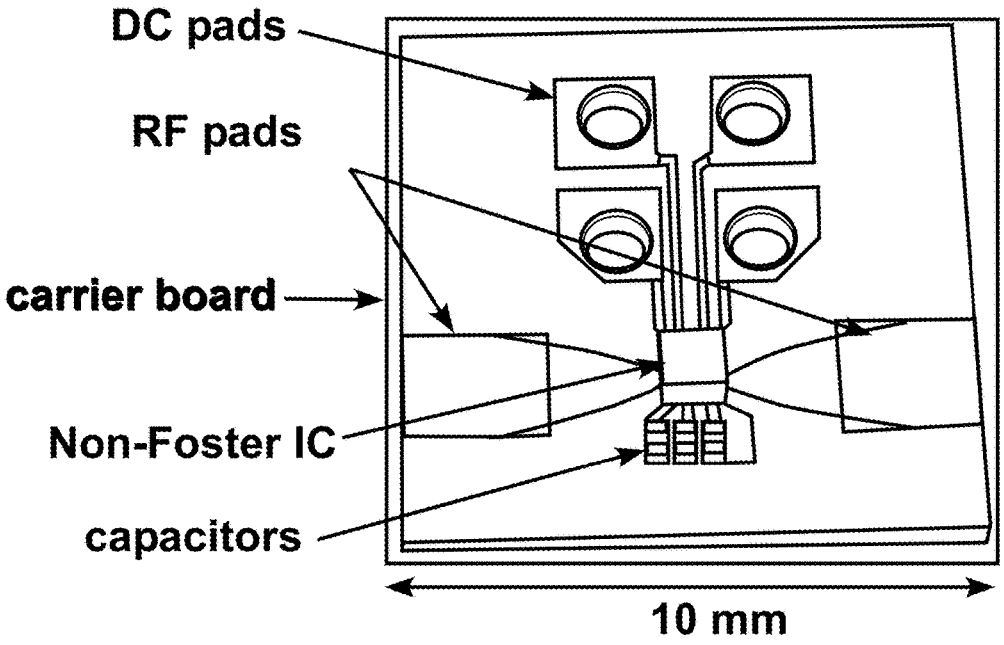
Fig. 2a prior art
Figure 2B:
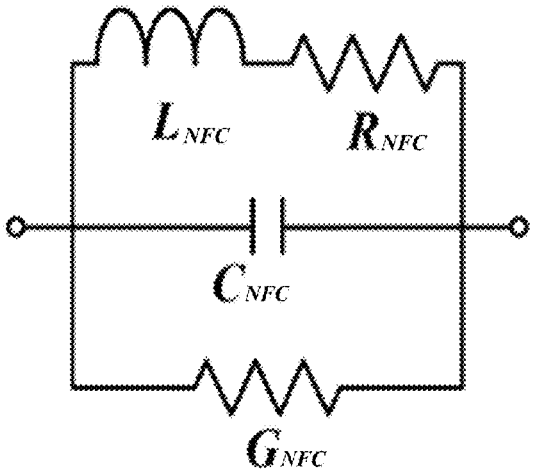
Fig. 2b prior art
FIG. 2*b* depicts an equivalent circuit model of the NFC on the NFC IC.
Figure 3:
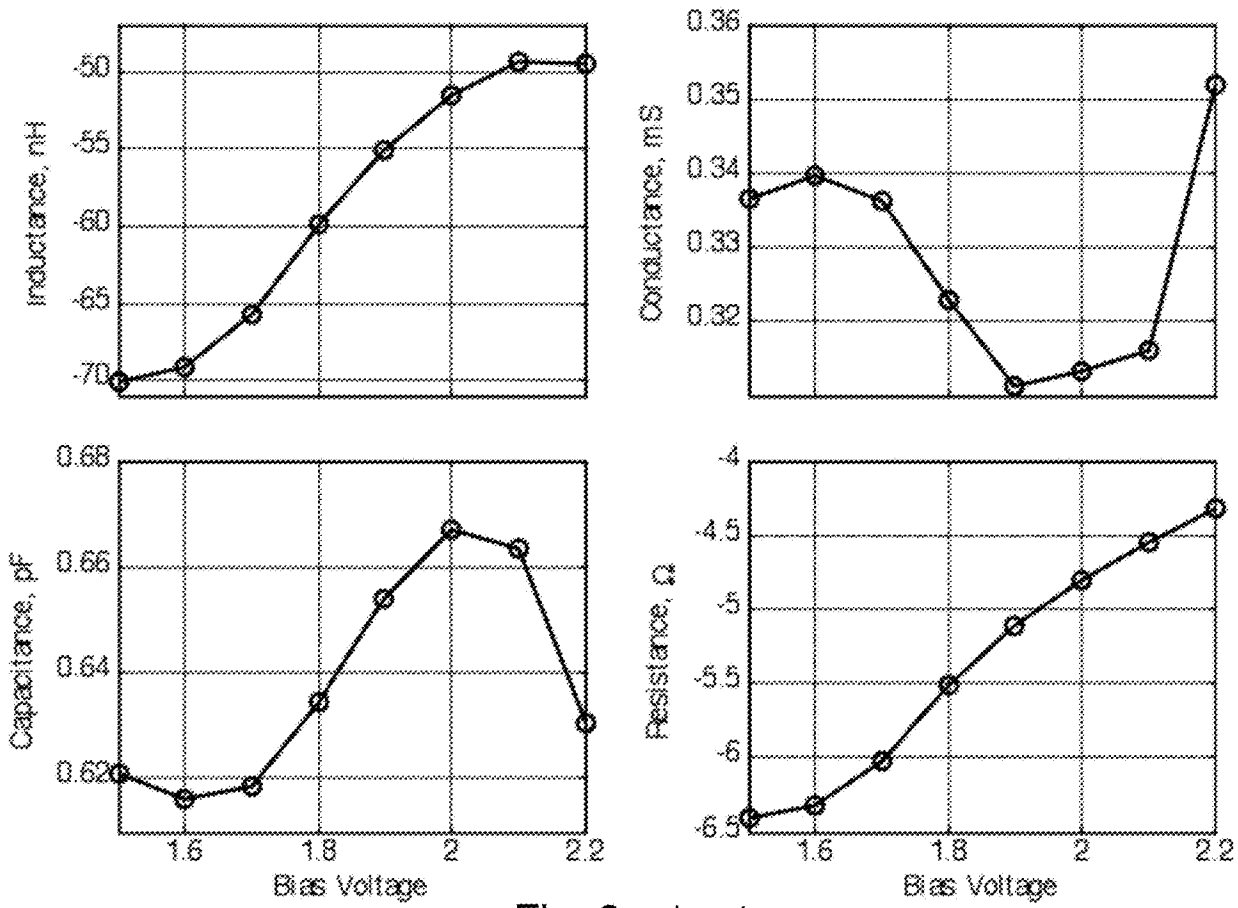
Fig. 3 prior art
FIG. 3 provides graphs of the equivalent circuit parameters of a prior-art non-Foster circuit vs. an applied bias voltage that is used to tune its negative inductance.

In the upper left hand corner of FIG. 4*a*3 are arrows denoting the directions of the E and H fields as well at the direction of propagation (the k vector) of an incident RF wave, assuming that the incident RF wave is normal (i.e. perpendicular) to the major surface the AAMC (the plane of the major surface of the AAMC is identified a dashed line 18 on FIGS. 4*a*2 and 4*a*3). However, those skilled in this technology will recognize the fact that the incident RF wave may instead be oblique to the major surface of the AAMC in which case the direction indicated for the E & H fields would be rotated so that $\hat{e}\times\hat{h}=\hat{k}$, where $\hat{e}$ is the unit vector in the direction of the incident electric RF waves, $\hat{h}$ is the unit vector in the direction of the incident magnetic RF waves and $\hat{k}$ is the unit vector in the direction of the propagation of the incident RF waves.

Impedance load elements 30, preferably formed by negative inductance NFCs, couple neighboring patch elements 22 arranged in columns following the y axis of FIG. 4*a*1 by imposing their synthesized negative inductance between those neighboring patch elements 22. The NFCs 30 are preferably disposed at a mid point of each patch 22 in a column (in the y-direction) of patches 22.

See also FIGS. 4*b*1 and 4*b*2 show a plan (or top) view and a side elevational perspective (or end perspective) view, respectively, of a prototype AAMC with isolating plates 20. The NFCs 30 in this embodiment are mounted on the carrier board of FIG. 2*a* and plurality of the carrier boards of FIG. 2*a* (with NFCs 30) are mounted on the embodiment of FIGS. 4*b*1 and 4*b*2. The isolating plates 20 span the substrate 28 from its ground plane 24 to a number of the metallic patch elements 22 disposed in a row following the x axis. The metallic patch elements 22 may each be formed in a common square shape as shown (it being understood that the metallic patches 22 may assume other geometric shapes, including rectangles, if desired) which are arranged is a two dimensional array disposed on substrate 28. The metallic patch elements 22 are spaced from each other on substrate 28 by a distance or gap 26 so that some of the underlying substrate 28 may be seen between them in FIG. 4*al*. Impedance load elements 30, preferably formed by negative inductance NFCs, couple neighboring patch elements 22 arranged in columns following the y axis of FIG. 4*a*1 and are disposed as shown in the gaps 26. The RF isolation plates 20 are ohmically coupled to the patch elements 22 overlying them as well as to the underlying ground plane 24. The RF isolation plates 20 may abut the patch elements 22 and the ground plane 24 (as shown in the embodiment of FIGS. 4*a*1 and 4*a*2 and in the embodiment of FIG. 6) or the RF isolation plates 20 may protrude thru (penetrate) the patch elements 22 and the ground plane 24, if desired (see the embodiment of FIGS. 4*b*1-4*b*3).

Openings (not shown) may be provided in substrate 28 to allow for electrical connections to be made to the DC connections or pads (see for example FIG. 2*a*) of the impedance load elements 30, preferably formed by negative inductance NFCs. The RF connections or pads, where the negative inductance is synthesized, are connected to the patches 22 disposed on either side of the NFCs 30.

The AAMC operates for incident RF waves polarized perpendicular to the isolation plates 20 as denoted by the arrow on FIG. 4*al*. Incident radiation polarized along the other axis will be reflected as from a metal conductor because of its interaction with the isolation plates 20. NFCs 30 adjacent to each other in the H plane do not couple in an unstable manner. The arrow of FIG. 4*a*1 shows the direction of the electric field vector for incident RF waves that are co-polarized to the AAMC. Note that the direction of the electric field vector for incident RF waves is perpendicular (orthogonal) to the planes occupied by isolation plates 20.

Optionally, as is depicted by FIG. 4*a*3, each metallic patch element 22 may be formed in two parts ($\mathbf{22}_1$ and $\mathbf{22}_2$) to allow a proximate elongate edge $\mathbf{20}_p$ of each RF isolation plate 20 to protrude through each metallic patch element 22 to facilitate making an electrical connection (at 32) between the RF isolation plates 20 and the neighboring parts $\mathbf{22}_1$ and $\mathbf{22}_2$ of an adjacent metallic patch element 22. The distal elongate edge $\mathbf{20}_d$ of each RF isolation plate 20 may similarly protrude through the ground plane 24 to facilitate making an electrical connection (at 32) between the RF isolation plates 20 and ground plane 24, as also shown in FIG. 4*a*3. The connections at 32 may be formed by soldering, brazing, a conductive adhesive (such as epoxy laden with silver) or by the use of electrically conductive tape or even by some mechanical means such as mechanical fasteners or a compression or spring contact force or tension at 32.

Figure 5A:
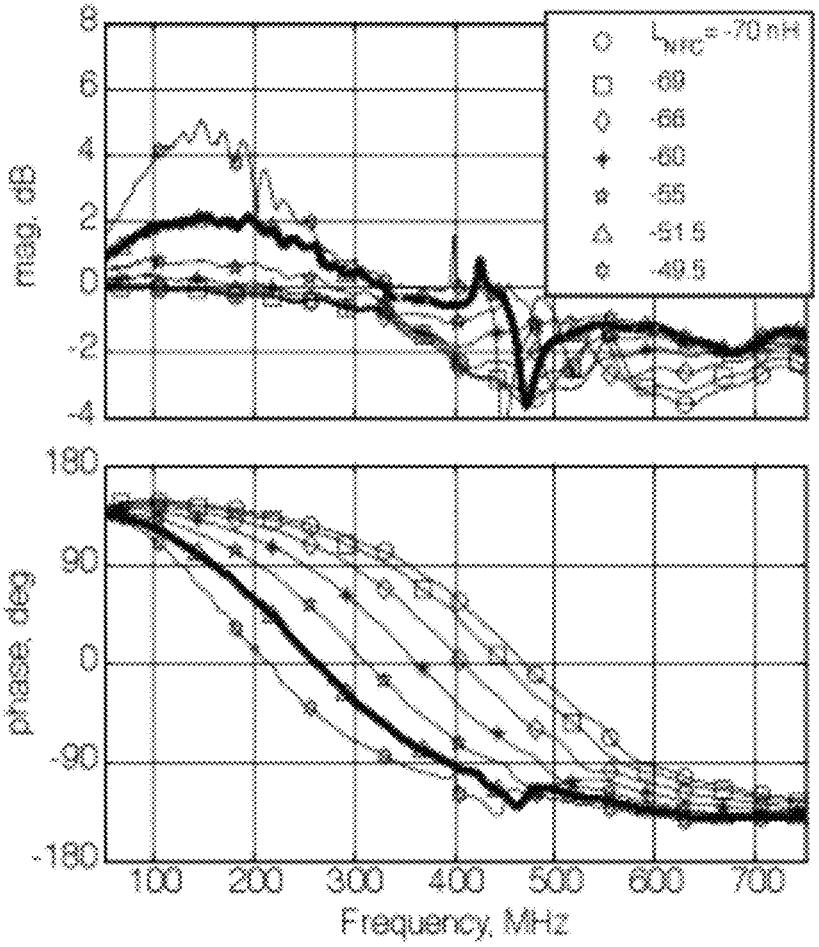

FIGS. 5*a* and 5*b* show measurements of the coax AAMC (see Gregoire) that confirm its operation as a stable wideband AMC with normal (perpendicular to the major surface of the AAMC) incidence of the RF wave. The NFC inductance was tuned from −70 to −49.5 nH. The phase and magnitude of a reflected wave vs. frequency for is shown in FIG. 5*a*. In this AAMC, the resonant frequency can be tuned from approximately 470 MHz to 220 MHz while maintaining stability. When tuned to 263 MHz, (represented by the bold line in FIG. 5*a* with NFC inductance tuned to −51.5 nH), the ±90° bandwidth is more than 80%, spanning the range from 160 to 391 MHz. The AAMC has much higher bandwidth than an equivalently-sized passive AMC using varactors instead of NFCs (see FIG. 5*b*). The AAMC has better than five times the bandwidth of the varactor-loaded passive AMC at high loading levels. The AAMC measured for FIG. 5*b* had square patches 22 which were 65 mm on a side, spaced apart by a gap 26 of 10 mm and disposed on a dielectric substrate 28 formed of a foam dielectric such as styrofoam or Rohacell® foam made by Evonik Industries AG of Essen, Germany.

These graphs show stability when the AAMC includes the RF isolation plates 20 disclosed herein. Building the AAMC without the RF isolation plates 20 disclosed herein resulted in instability.

The substrate 28 shown in FIGS. 4*a*1-4*a*3 may be a dielectric material such as that found in printed circuit boards in printed circuit board material may be conveniently used to make the disclosed Linearly Polarized Active Artificial Magnetic Conductor. However, other materials may be used instead and indeed the substrate material 28 may be omitted altogether since air or a vacuum also function as a dielectric.

The RF isolation plates 20 couple the patches 22 to the ground plane in some ways similar the single post (see the "via to ground") shown in FIG. 1, but the laterally extending walls formed by the RF isolation plates 20 preferably completely span the AAMC from one side thereof to the other side thereof as shown in FIG. 4*a*1 markedly improve stability by isolating the detrimental coupling which otherwise occurs between neighboring NFCs 30. Having said that, it is believed that the RF isolation plates 20 can be implemented more like a fence or a screen (rather than necessarily a solid wall of metallic material). For example, each RF isolation plate 20 may be made up of many relatively small metallic RF isolation plates or posts 21 arranged in rows. See FIG. 6 where many posts 21 are shown disposed between (and ohmically coupled to) each patch 22 and the ground plane 24. Look again at FIG. 4*a*1 where the the RF isolation plates 20 are depicted by dashed lines since they are under the patches 22 in that view of that embodiment. But now consider that each of those dashes represents a post 21 of an RF isolation plate 20 as opposed to a solid metallic wall forming an RF isolation plate 20, which would then correspond to the embodiment of FIG. 6.

The spacings of the posts 21 in the embodiment of FIG. 6 need to be sufficiently close to isolate the detrimental coupling which otherwise occurs between neighboring NFCs 30. Preferably the fill factor of the posts is at least 50% (so that the gaps between the posts are preferably smaller than the widths of the posts themselves). It may well be easier from a manufacturing point of view to fill a large number of vias with metallic material to thereby form the posts 21 which in turn define the RF isolation plates 20 as opposed to making the RF isolation plates 20 from discrete pieces of metal and then inserting them into or disposing them in the AAMC. The posts 21 may also fill the gaps 26 if needed for better isolation the detrimental coupling which can occur between neighboring NFCs 30. Also the posts 21 may be so closely positioned relative to each other as to effectively create an essentially solid wall of metal (so the fill factor is then essentially 100%), so the wall 20 may be formed by the metallic disposition of metal using printed circuit board or 3D printing techniques as opposed to making the RF isolation plates 20 from discrete pieces of metal. Indeed, 3D printing techniques can likely be used to fabricate the entire AAMC except for the NFCs 30 which can be made using semiconductor fabrication techniques.

Also instead of making the RF isolation plate 20 from a solid wall of metallic material or from rows of posts 21, the RF isolation plate 20 may alternatively be formed from a screen or mesh of electrically conductive material if desired. But if a mesh or screen is used in lieu of a solid wall of material, the fill factor of the metal in the screen or mesh would preferably be greater than 50% to better achieve the desired isolation between the NFCs 30. To help connote that fact that the isolation plate 20 need not necessarily be formed solid metallic material, the term isolating wall is used in the appended claims.

Each patch 22 is coupled to the ground plane 24 preferably by the aforementioned RF isolation plates 20 (or posts 21). The patches 22 may also be coupled to ground by other means such as by installing the AAMC in a metallic cavity (when used with cavity-backed slot antenna for example) so that the edges of the metallic cavity also act to couple patches at the edges of the cavity to ground. The patches 22 and the ground plane 24 may be formed of copper and may each be of the same thickness.

Having now described the invention in accordance with the requirements of the patent statute, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary embodiments is presented for purposes of illustration and disclosure in accordance with the requirements of the patent statute. It is not intended to be exhaustive nor to limit the invention to the precise form(s) described, but only to enable others skilled in the art to understand how the invention may be suited for a particular use or implementation. The possibility of modifications and variations will now be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ".

What is claimed is:

1. An active artificial magnetic conductor comprising: an array of unit cells arranged in a plurality of rows and columns, each unit cell comprising an electrically conductive patch spaced from a ground plane, the electrically conductive patches of the unit cells arranged in each column of unit cells being coupled via a Non-Foster Circuit (NFC) impedance element to an electrically conductive patch of a neighboring unit cell in each column of unit cells and the electrically conductive patches of the unit cells arranged in each row of unit cells being connected via an electrically conductive isolating wall to said ground plane at a mid point of each electrically conductive patch in the row of unit cells, the electrically conductive isolating walls of the rows of unit cells comprising electrically conductive material which occupies a majority of space between opposing edges of electrically conductive patches in each row of unit cells.

2. The active artificial magnetic conductor of claim 1 wherein each electrically conductive patch is a metallic patch of a predetermined geometric shape.

3. The active artificial magnetic conductor of claim 2 wherein each electrically conductive patch is a square metallic patch.

4. The active artificial magnetic conductor of claim 1 wherein each electrically conductive isolating wall is formed of an integral piece of metal extending across each unit cell.

5. The active artificial magnetic conductor of claim 1 wherein the electrically conductive isolating walls are each formed by linear arrays closely spaced metallic posts.

6. A method of electrically stabilizing an active artificial magnetic conductor, the active artificial magnetic conductor comprising an array of unit cells, each unit cell comprising an electrically conductive patch that is (i) spaced from a ground plane of the active artificial magnetic conductor and (ii) connected to a neighboring electrically conductive patch with a non-Foster negative inductor in a direction parallel to an E-plane, the method comprising reducing E-plane coupling between the non-Foster negative inductors of the active artificial magnetic conductor by disposing, forming or inserting isolating walls in a direction parallel to an H-plane between the non-Foster negative inductors, the isolating walls further extending in a direction perpendicular to said E-plane between neighboring electrically conductive patches and occupying a majority of a space between opposing edges of the neighboring electrically conductive patches in the direction perpendicular to said E-plane, the isolating walls being coupled to said ground plane.

7. The method of claim 6 wherein the array of unit cells comprises a two dimensional array of unit cells arranged in columns and rows, the isolating walls are disposed between pairs electrically conductive patches at a mid point of each of said pairs of electrically conductive patches in adjacent rows of electrically conductive patches while the non-Foster negative inductors are disposed at a mid point of each electrically conductive patch in adjacent columns of electrically conductive patches.

8. The method of claim 6 wherein the isolating walls are formed of a solid plate of metallic material.

9. The method of claim 6 wherein each unit cell has dielectric material disposed between the electrically conductive patch and the ground plane of the active artificial magnetic conductor, the isolating walls being formed by forming a plurality of vias in said dielectric substrate and filling said vias with a metallic material.

10. The method of claim 6 wherein each electrically conductive patch has a rectilinear shape.

11. The method of claim 6 wherein each electrically conductive patch has a square shape.

12. The method of claim 11 where the active artificial magnetic conductor is responsive to incident RF waves and wherein said E-plane and said H-plane correspond, respectively, to an E-plane and said H-plane of said incident RF waves.

13. An active artificial magnetic conductor responsive to incident RF waves, the active artificial magnetic conductor comprising an array of unit cells, each unit cell comprising an electrically conductive patch that is (i) spaced from a ground plane of the active artificial magnetic conductor and (ii) connected to neighboring electrically conductive patches with non-Foster negative inductors in a direction parallel to an E-plane of the incident RF waves, the active artificial magnetic conductor including means for reducing the E-plane coupling between the non-Foster negative inductors of the active artificial magnetic conductor comprising isolating walls disposed, formed or inserted in a direction perpendicular to the E-plane between the non-Foster negative inductors, the isolating walls being disposed in a common linear direction between neighboring electrically conductive patches parallel to the H-plane of the incident RF waves, each isolating wall extending between the ground plane of the active artificial magnetic conductor and the electrically conductive patch of each unit cell, each isolating wall occupying a majority of a space between opposing edges of the electrically conductive patches in the direction perpendicular to the E-plane.

14. The active artificial magnetic conductor of claim 13 wherein the array of unit cells comprises a two dimensional array of unit cells arranged in columns and rows, the isolating walls being disposed at a mid point of each electrically conductive patch in a row of electrically conductive patches while the non-Foster negative inductors are disposed at a mid point of each electrically conductive patch in a column of electrically conductive patches.

15. The active artificial magnetic conductor of claim 13 wherein the isolating walls comprise a solid plate of metallic material extending between opposing edges of the electrically conductive patch of each unit cell.

16. The active artificial magnetic conductor of claim 13 wherein each unit cell has a dielectric material disposed between the electrically conductive patches and the ground plane of the active artificial magnetic conductor, the isolating walls being defined by a plurality of metallic posts in said dielectric substrate.

17. The active artificial magnetic conductor of claim 16 wherein said metallic posts associated with each unit cell are arranged in a rectilinear array of posts.

18. The active artificial magnetic conductor of claim 13 wherein each electrically conductive patch has a rectilinear shape.

19. The active artificial magnetic conductor of claim 18 wherein each electrically conductive patch has a square shape.

20. A magnetic conductor comprising: an array of unit cells arranged in a plurality of rows and columns, each unit cell comprising an electrically conductive patch spaced from a ground plane, the electrically conductive patches of the unit cells arranged in each column of unit cells being coupled via a Non-Foster Circuit (NFC) impedance element to an electrically conductive patch of a neighboring unit cell in each column of unit cells, the electrically conductive patches of the unit cells arranged in each row of unit cells having an electrically conductive isolating wall connected to said ground plane and connected at a mid point of each electrically conductive patch in the row of unit cells and the electrically conductive isolating walls of the rows of unit cells extending along a majority of the distance between opposing edges of electrically conductive patches in each row of unit cells.

21. The magnetic conductor of claim 20 wherein each electrically conductive patch is a metallic patch of a predetermined geometric shape.

22. The magnetic conductor of claim 21 wherein each electrically conductive patch has a square metallic patch.

* * * * *